US005286537A

United States Patent [19]

Oita et al.

[11] Patent Number: 5,286,537

[45] Date of Patent: Feb. 15, 1994

[54] DOUBLE GLAZING GLASS

[75] Inventors: Shinji Oita; Kazuhiro Otani, both of Osaka; Hiroaki Arai, Nara, all of Japan

[73] Assignees: Nippon Sheet Glass Co., Ltd.; Tsutsunaka Plastic Industry Co., Ltd., Osaka, Japan

[21] Appl. No.: 793,155

[22] Filed: Nov. 18, 1991

[30] Foreign Application Priority Data

Dec. 27, 1990 [JP] Japan ..... 2-407996

[51] Int. Cl.[5] ..... E06B 3/24; E04C 2/54

[52] U.S. Cl. ..... 428/34; 428/192; 52/788; 52/790

[58] Field of Search ..... 428/34, 167, 192, 81, 428/139, 412, 428, 446; 156/107, 109; 52/171, 172, 788, 789, 790

[56] References Cited

U.S. PATENT DOCUMENTS 4,268,553 5/1981 Marzouki et al. ..... 428/34

*Primary Examiner*—Donald J. Loney

*Attorney, Agent, or Firm*—Kanasaka and Takeuchi

[57] ABSTRACT

A double glazing glass which comprises two transparent sheets superposed one on top of the other through the medium of spacers disposed along the edge parts thereof, a primary sealant joining the spacers to the transparent sheets, and a secondary sealant filling the gaps formed on the outer sides of the spacers between the opposed transparent sheets, wherein at least one polycarbonate sheet in the two transparent sheets and an alcohol type silicone adhesive agent as the secondary sealant are used.

8 Claims, 2 Drawing Sheets

DOUBLE GLAZING GLASS

BACKGROUND OF THE INVENTION

1. Field of the Invention

This invention relates to a double glazing glass, particularly to a double glazing glass using a polycarbonate sheet, possessing a high sealing property in the joined part and, therefore, having no possibility of forming dew in the internal cavity thereof.

2. Description of the Prior Art

The double glazing glass produced by superposing two glass sheets one on top of the other has been known to the art. The conventional double glazing glass is obtained, as illustrated in FIG. 3 (plan view) and FIG. 4 (cross section taken through FIG. 3 along the line IV—IV), by superposing two glass sheets 11, 12 through the medium of spacers 13 disposed along the four edges of the glass sheets, joining the spacers 13 and the glass sheets 11, 12 with a primary sealant 14 and filling the grooves formed on the outer sides of the spacers 13 and between the joined glass sheets with a secondary sealant 15. A total of four linear spacers 13 is disposed along the four opposed edges of the superposed glass sheets. The corner parts of the intervening space between the superposed glass sheets are fixed by connecting the terminal parts of the spacers 13 with a corner key 16. The spacer 13 is each a hollow member provided on the inner peripheral side thereof with an aperture 13A. The hollow part of each of the spacers is generally filled with a desiccant 17.

This sealing method for the double glazing glass which is described above is called the "dual-seal method" and is a part of leading methods currently available for sealing the double glazing glass. The primary sealant 14 is made of butyl rubber and the secondary sealant 15 is made of a polysulfide or silicone type (acetic acid type) compound. The spacers 13 are made prevalently of an aluminum substance.

Incidentally, a polycarbonate sheet possesses conspicuously high impact resistance, excels in crack resistance and penetration resistance, and exhibits high safety as compared with a glass sheet and, as such, has been attracting attention as an ideal substitute for the glass sheet. Studies are now under way in search of a feasible double glazing glass using a polycarbonate sheet.

The adhesiveness of the polycarbonate sheet, however, has so far discouraged major glass manufactures from commercializing a double glazing glass using a polycarbonate sheet. Though double glazing glasses of this sort are being produced nominally, they are deficient in durability and other properties.

When a double glazing glass is constructed by the "dual-seal method" using a polycarbonate sheet as illustrated in FIG. 3 and FIG. 4, the primary sealant of butyl rubber manifests its sealing effect, whereas the second sealant which is generally made of a polysulfide type or silicone type(acetic acid type) compound defies adhesion to the polycarbonate sheet. The produced double glazing glass, therefore, encounters interfacial separation between the polycarbonate sheet and the second sealant. Though the idea of subjecting the polycarbonate sheet to a primer treatment for the purpose of imparting improved adhesiveness to the polycarbonate sheet is conceivable, the application of the primer treatment to the polycarbonate sheet is infeasible because the polycarbonate sheet is cracked by the solvent used in the treatment.

The currently available double glazing glasses using a polycarbonate sheet, therefore, rely for adhesion of the component sheets substantially upon the primary sealant. When any of the sealed parts using this primary sealant is injured, the part is no longer capable of sealing the double glazing glass and the air space formed in the inner cavity admits moisture and suffers formation of dew on the inner sheet surfaces. Further, because the spacers and the corner keys are separate articles, it naturally follows that gaps occur therebetween. Since the secondary sealant has only an insufficient sealing property, the moisture from the ambient air finds its way into the air space in the inner cavity through the gap. Again, this moisture possibly forms dew on the inner sheet surfaces.

SUMMARY OF THE INVENTION

An object of this invention is to solve the problem encountered by the prior art as described above and provide a double glazing glass whose superposed parts are sealed ideally so as to preclude the problem of dew formation on the inner sheet surfaces thereof.

This invention is directed to a double glazing glass comprising two transparent sheets superposed through the medium of spacers disposed along the edge parts of the transparent sheets, a primary sealant joining the spacers to the transparent sheets, and a secondary sealant filling the grooves formed on the outer sides of the spacers between the superposed sheets, at least one of the transparent sheets is a polycarbonate sheet and the second sealant is an alcohol type silicone adhesive agent.

The alcohol type silicone adhesive agent adheres very strongly to the polycarbonate sheet without requiring a primer treatment. In accordance with the double glazing glass of the present invention, therefore, the superposed parts of the glass enjoy a very high sealing property because not only the primary seal but also the secondary seal manifest a fully satisfactory sealing effect.

In the double glazing glass of the present invention, the spacers to be disposed along the opposed edge parts are formed by bending one continuous spacer piece or arranging four separate spacer pieces in a rectangular pattern. The communication between the interior and the exterior of the double glazing glass is shut off by the corner parts of the double glazing glass.

No gap is formed in the corner parts when the spacers are formed by bending one continuous spacer piece. The gaps formed in the corner parts are to be sealed when the spacers are formed by joining separate spacer pieces. The otherwise possible phenomenon of dew formation due to leakage of moisture, therefore, can be precluded all the more infallibly because the communication between the interior and the exterior of the double glazing glass is completely shut off as described above.

objects and characteristic features of the present invention will become apparent as the disclosure is made in the following description of preferred embodiments, as illustrated in the accompanying drawings.

DESCRIPTION OF PREFERRED EMBODIMENTS

Now, this invention will be described in detail below with reference to the accompanying drawings.

Figure 1:
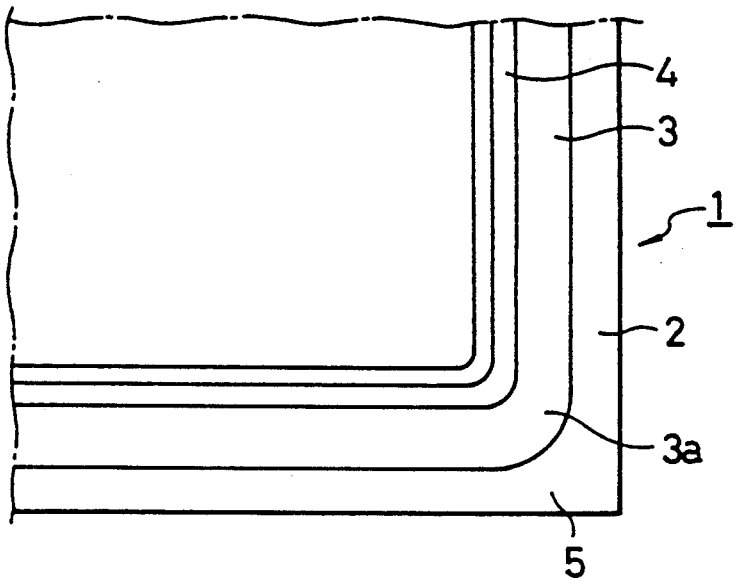
FIG. 1 is a plan view illustrating a double glazing glass as one embodiment of this invention.
Figure 3:
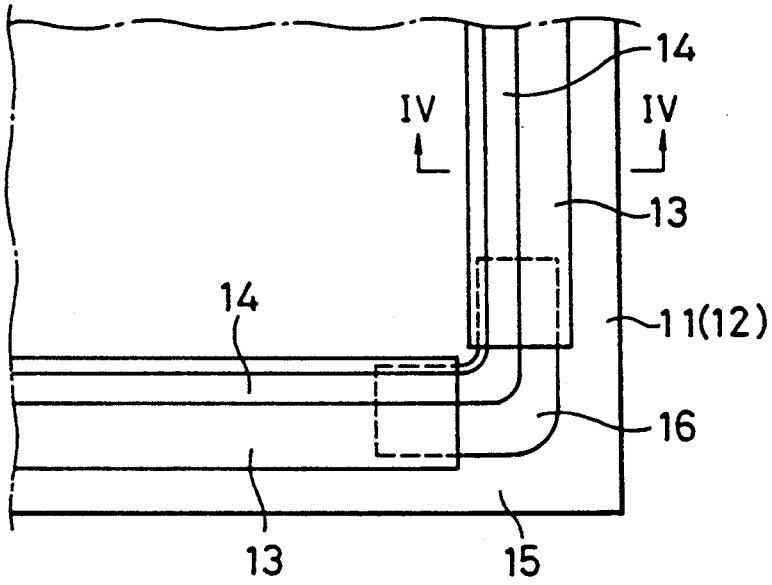
FIG. 3 is a plan view illustrating a conventional countertype.
Figure 4:
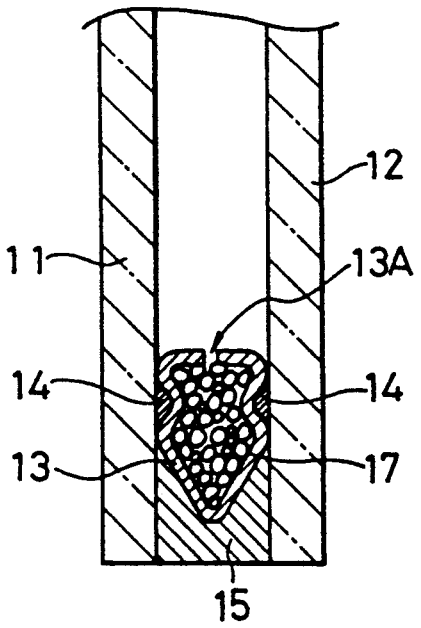
FIG. 4 is a cross section taken along the line IV—IV in FIG. 3.

A double glazing glass 1 illustrated in FIG. 1 has a polycarbonate sheet 2 as one of the opposed transparent sheets and an alcohol type silicone adhesive agent as a secondary sealant 5. It is identical to the double glazing glass illustrated in FIG. 3, except spacers 3 are formed by bending one continuous spacer piece. By 4 is denoted a primary sealant.

In the double glazing glass 1 constructed as described above, since the secondary sealant 5 possesses highly desirable adhesiveness to the polycarbonate sheet 2, the double glazing glass acquires a highly satisfactory secondary sealing effect. Moreover, since the spacers 3 are formed by bending one continuous spacer piece, the double glazing glass has no use for any corner key to be otherwise used in the corner parts 3*a*. Since no gap is formed in the corner parts, the double glazing glass is sealed very effectively and perfectly prevented from the otherwise inevitable infiltration of moisture.

Figure 2:
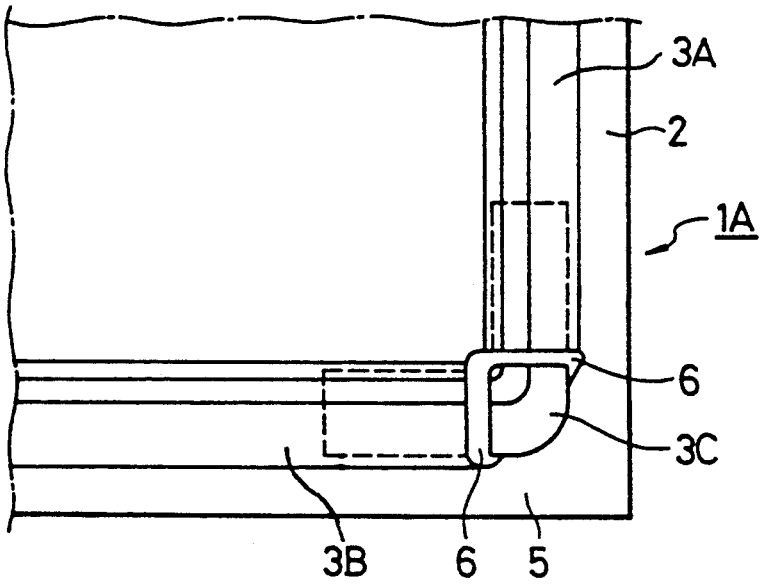
FIG. 2 is a plan view illustrating a double glazing glass as another embodiment of this invention.

The double glazing glass 1A illustrated in FIG. 2 has a polycarbonate sheet 2 as one of the opposed transparent sheets and uses an alcohol type silicone adhesive agent as the secondary sealant 5. It is identical to the double glazing glass illustrated in FIG. 3, except the spacers 3 are formed integrally by joining separate spacers 3A and 3B and corner keys 3C by means of soldering. By 4 is denoted a primary sealant.

The double glazing glass 1A constructed as described above is sealed highly effectively and prevented infallibly from the otherwise inevitable infiltration of moisture because the secondary sealant 5 produces a very high sealing effect and the gaps intervening between the separate spacers 3A, 3B and the corner keys 3C are completely shut with the solder 6.

As concrete examples of the alcohol type silicone adhesive agent to be used in the present invention, an adhesive agent produced by Toray Industries, Inc. and marketed under product code of "SE555" and an adhesive agent produced by Toshiba Industries, Inc. and marketed under trademark designation of "Tos-Seal 380" may be cited.

The double glazing glass of this invention need not be limited to a superposed pair of polycarbonate sheets but may be a combination of one polycarbonate sheet superposed on a glass sheet. In this case, the glass sheet may be a laminated glass or a tempered glass. The two superposed sheets of the double glazing glass of this invention including at least one polycarbonate sheet may be identical or not identical in surface area shape.

Now, a test example of this invention will be described below.

TEST EXAMPLE 1

A double glazing glass of this invention illustrated in FIG. 1 was produced by superposing a tempered glass (TP5) on a polycarbonate sheet of 12 mm in thickness.

A double glazing glass of this invention illustrated in FIG. 2 was produced by superposing a laminated glass sheet (FL3/intermediate film/FL3) on a polycarbonate sheet of 12 mm in thickness.

A primary sealant was made of butyl rubber and a second sealant was made of an adhesive agent produced by Toray Industries, Inc. and marketed under product code of "SE555." The spacers were made of aluminum.

The double glazing glasses obtained in different test runs, in a durability test carried out at 55° C. and 95% RH, kept a dew point below −60° C. for a period of 336 hours.

As described in detail above, the double glazing glass of this invention enjoys a highly satisfactory sealing property and perfect freedom from the problem of dew formation on the inner sheet surfaces. Further, owing to the use of at least one polycarbonate sheet, the produced double glazing glass excels in impact resistance and durability.

Since the double glazing glass of this invention avoids the phenomenon of dew formation on the inner sheet surfaces and excels in durability, it can be utilized very effectively as a safety inspection window for a lathe, for example.

What is claimed is:

1. A double glazing glass comprising two transparent sheets, spacers disposed along edge parts of said transparent sheets to superpose said transparent sheets through the spacers, grooves disposed along the edge parts, each groove being defined by the two transparent sheets and the spacer, a primary sealant disposed between the transparent sheet and the spacer and joining said spacers to said transparent sheets, and a secondary sealant filled in the grooves, wherein at least one of said transparent sheets is a polycarbonate sheet and said secondary sealant is an alcohol silicone adhesive agent for completely and directly sealing between the two transparent sheets.

2. A double glazing glass according to claim 1, wherein said spacers disposed along adjacent side parts of said double glazing glass are formed of one continuous spacer piece and a communication between an interior and an exterior of the double glazing glass is shut off by the spacer piece thereof.

3. A double glazing glass according to claim 1, wherein said spacer disposed along adjacent side parts of said double glazing glass for formed of separate spacer pieces and corner keys, and a communication between an interior and an exterior of the double glazing glass is shut off by the spacer pieces and the corner keys.

4. A double glazing glass according to claim 1, wherein one of said two transparent sheets is a polycarbonate sheet and the other is a glass sheet.

5. A double glazing glass according to claim 1, wherein said spacers are made of aluminum.

6. A double glazing glass according to claim 1, wherein said primary sealant is made of butyl rubber.

7. A double glazing glass according to claim 4, wherein said glass sheet is a sheet formed of a plurality of glass sheets laminated together.

8. A double glazing glass comprising:

two transparent sheets having edge parts, at least one of the sheets being a polycarbonate sheet, spacers having side portions and disposed along the edge parts of the transparent sheets to superpose the transparent sheets through the spacers such that grooves are formed along the edge parts, each groove being defined by the two transparent sheets and the spacer, a primary sealant disposed at the side portions of the spacers for sealingly connecting the spacers to the transparent sheets, said primary sealant being made of butyl rubber, and a secondary sealant filled in the grooves, said secondary sealant being an alcohol silicone adhesive agent to provide high sealing ability relative to the polycarbonate sheet so that the secondary sealant completely and directly seals between the two transparent sheets.

* * * * *